US011121460B2

(12) United States Patent
Mo et al.

(10) Patent No.: US 11,121,460 B2
(45) Date of Patent: Sep. 14, 2021

(54) ANTENNA COMPONENT AND ELECTRONIC DEVICE

(71) Applicant: Lenovo (Beijing) Co., Ltd., Beijing (CN)

(72) Inventors: Dafei Mo, Beijing (CN); Xiaoren Cheng, Beijing (CN); Xiaozhun Shen, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 80 days.

(21) Appl. No.: 16/727,897

(22) Filed: Dec. 26, 2019

(65) Prior Publication Data

US 2020/0212560 A1 Jul. 2, 2020

(30) Foreign Application Priority Data

Dec. 29, 2018 (CN) ..... 201811647572.3

(51) Int. Cl.

| | |
|---|---|
| ***H01Q 13/00*** | (2006.01) |
| ***H01Q 1/52*** | (2006.01) |
| ***H01Q 1/42*** | (2006.01) |
| ***H01Q 1/02*** | (2006.01) |

(52) U.S. Cl.

CPC ..... *H01Q 1/521* (2013.01); *H01Q 1/02* (2013.01); *H01Q 1/42* (2013.01)

(58) Field of Classification Search

CPC ..... H01Q 1/521; H01Q 1/42; H01Q 1/02; H01Q 1/2266; H01Q 13/18

USPC ..... 343/872

See application file for complete search history.

(56) References Cited

U.S. PATENT DOCUMENTS

| | | | | |
|---|---|---|---|---|
| 8,624,788 | B2 * | 1/2014 | Ayatollahi | H01Q 1/521 343/745 |
| 8,933,847 | B2 * | 1/2015 | Yang | H01Q 1/243 343/702 |
| 10,418,693 | B2 * | 9/2019 | Xu | H01Q 1/273 |
| 10,784,592 | B2 * | 9/2020 | Martiskainen | H01Q 1/243 |
| 10,797,383 | B2 * | 10/2020 | Xu | G04G 17/08 |
| 10,862,223 | B2 * | 12/2020 | McGough | H01Q 1/521 |
| 2003/0151557 | A1 * | 8/2003 | Johnson | H01Q 5/328 343/702 |
| 2008/0316117 | A1 * | 12/2008 | Hill | H01Q 21/30 343/702 |

(Continued)

FOREIGN PATENT DOCUMENTS

| | | | |
|---|---|---|---|
| CN | 101958456 | A | 1/2011 |
| CN | 105938383 | A | 9/2016 |

(Continued)

*Primary Examiner* — Jean B Jeanglaude

(74) *Attorney, Agent, or Firm* — Anova Law Group, PLLC

(57) ABSTRACT

An antenna assembly is provided for an electronic device. The electronic device has a housing, which includes a first portion and a second portion, the first portion is electrically conductive, and the second portion is non-conductive. The antenna assembly includes an antenna cavity, at least two antennas located in the antenna cavity, and at least one isolation structure. The antennas are used for radiating energy, the isolation structure is disposed between the two antennas and connected to the two antennas, and the isolation structure isolates induced currents of the two antennas to reduce interference at a same frequency or from adjacent frequency channels between the two antennas.

20 Claims, 2 Drawing Sheets

(56) References Cited

U.S. PATENT DOCUMENTS

| | | | | |
|---|---|---|---|---|
| 2015/0119052 | A1* | 4/2015 | Caimi | H01Q 5/48<br>455/450 |
| 2015/0280313 | A1 | 10/2015 | Sanford et al. | |
| 2018/0294554 | A1* | 10/2018 | Xu | A61B 5/6831 |

FOREIGN PATENT DOCUMENTS

| | | | |
|---|---|---|---|
| CN | 207305265 | U | 5/2018 |
| CN | 109103583 | A | 12/2018 |

* cited by examiner

ANTENNA COMPONENT AND ELECTRONIC DEVICE

CROSS-REFERENCES TO RELATED APPLICATIONS

This application claims priority of Chinese Patent Application No. 201811647572.3, filed on Dec. 29, 2018, the entire contents of which are hereby incorporated by reference.

FIELD OF THE DISCLOSURE

The present disclosure generally relates to the field of antenna technology and, more particularly, relates to an antenna assembly and an electronic device having the same.

BACKGROUND

In the future, LTE (long-term-evolution) or 5G (Fifth Generation) technologies will be more and more integrated in thin and light notebooks and tablets to meet the requirements that users need to access the Internet anytime and anywhere and that the speed of the Internet needs to get faster and faster. Existing LTE and future 5G communication systems need to use at least 4 antennas to achieve a 1 Gbps (Gigabits per second) communication rate, and the number of antennas will only increase, not decrease, in the future. The 4-antenna configurations have become mainstream now. Adding two WIFI (Wi-Fi, or wireless fidelity) antennas, there are 6 antennas in one system, presenting serious challenges to the system design of the metal casings for the electronic equipment.

At present, to include antennas in a system, antenna windows often are opened on a metal casing, and multiple antennas are separately arranged. That is, only one antenna is placed in each antenna window to meet the requirement of isolation between antennas, resulting in a large number of antenna windows and higher cost of opening windows. At the same time, the antennas require a large space, which can affect the size of the electronic equipment.

The disclosed methods and systems are directed to solve one or more problems set forth above and other problems.

BRIEF SUMMARY OF THE DISCLOSURE

One aspect of the present disclosure provides an antenna assembly for an electronic device. The electronic device has a housing, which includes a first portion and a second portion, the first portion is electrically conductive, and the second portion is non-conductive. The antenna assembly includes an antenna cavity, at least two antennas located in the antenna cavity, and at least one isolation structure. The antennas are used for radiating energy, the isolation structure is disposed between the two antennas and connected to the two antennas, and the isolation structure isolates induced currents of the two antennas to reduce interference at a same frequency or from adjacent frequency channels between the two antennas.

Another aspect of the present disclosure provides a method for providing an antenna assembly for an electronic device. The electronic device has a housing, which includes a first portion and a second portion, the first portion is electrically conductive, and the second portion is non-conductive. The method includes providing an antenna cavity in the electronic device; disposing at least two antennas in the antenna cavity; and providing at least one isolation structure between the two antennas. The antennas are used for radiating energy, and the isolation structure is connected to the two antennas, so as to isolate induced currents of the two antennas to reduce interference at a same frequency or from adjacent frequency channels between the two antennas.

Another aspect of the present disclosure provides an electronic device. The electronic device includes a housing and an antenna assembly disposed in the housing. The housing includes a first portion and a second portion, the first portion is electrically conductive, and the second portion is non-conductive. The antenna assembly includes an antenna cavity, at least two antennas located in the antenna cavity, and at least one isolation structure. The antennas are used for radiating energy, the isolation structure is disposed between the two antennas and connected to the two antennas, and the isolation structure isolates induced currents of the two antennas to reduce interference at a same frequency or from adjacent frequency channels between the two antennas.

Other aspects of the present disclosure can be understood by those skilled in the art in light of the description, the claims, and the drawings of the present disclosure.

BRIEF DESCRIPTION OF THE DRAWINGS

To more clearly illustrate the technical solutions of this disclosure, the accompanying drawings will be briefly introduced below. Obviously, the drawings are only part of the disclosed embodiments. Those skilled in the art can derive other drawings from the disclosed drawings without creative efforts.

DETAILED DESCRIPTION

In order to understand the features and technical contents of the embodiments of the present disclosure in more detail, the implementation of the embodiments of the present disclosure will be described in detail below with reference to the accompanying drawings. The attached drawings are for reference only and are not intended to limit the embodiments of the present disclosure. Further, the described embodiments are merely part, not all, of the embodiments of the present disclosure. Based on the disclosed embodiments, other embodiments obtained those skilled in the art without creative efforts shall fall within the protection scope of the present disclosure.

The present disclosure provides an antenna assembly and an electronic device thereof, which can reduce the window opening cost, reduces the space required by the antennas, and reduces the size of the electronic device.

Figure 1A:
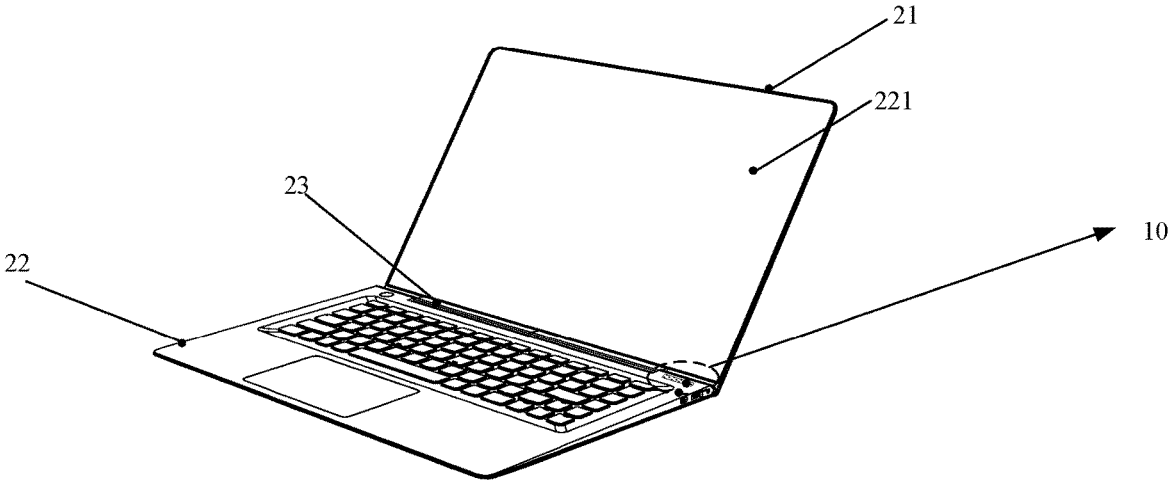
FIG. 1A illustrates a schematic structural diagram of an electronic device consistent with the disclosed embodiments.

FIG. 1A is a structural schematic diagram of an electronic device according to embodiments of the present disclosure. As shown in FIG. 1A, the electronic device includes a first body 21, a second body 22, and a connecting member 23, etc.

The first body 21 and the second body 22 are connected through the connecting member 23, and the first body 21 and the second body 22 can be relatively rotated through the connecting member 23. In one embodiment, a display device 221 is provided on the first body 21, and the display device 221 is used for displaying an interface or any information or graphics.

The second body 22 may have a housing (not labelled) to house various components of the electronic device. In one embodiment, the housing is provided to contain an antenna assembly 10. The housing may also contain other components, such as a keyboard. Although a laptop type computing device is shown in FIG. 1A, the electronic device may be any type of mobile computing device.

Figure 1B:
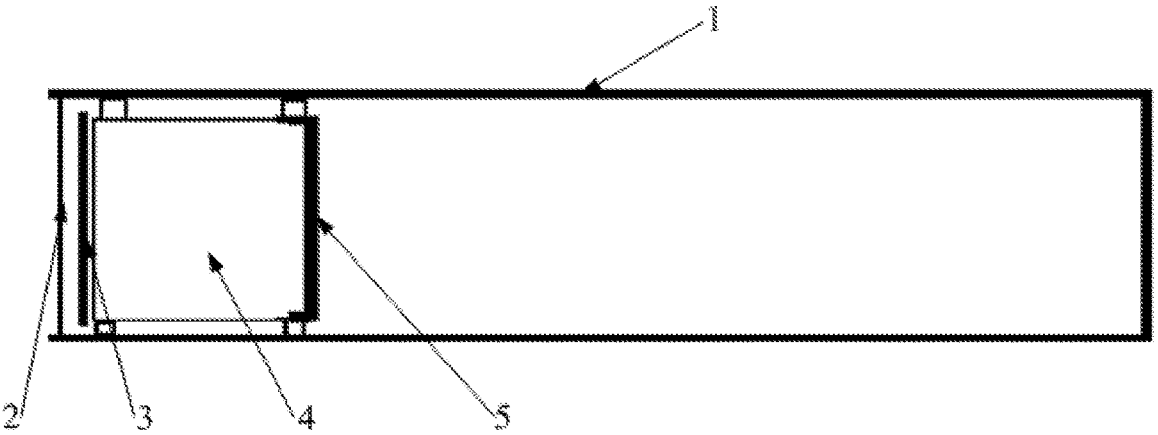
FIG. 1B illustrates a cross-section view of an antenna assembly consistent with the disclosed embodiments.
Figure 2:
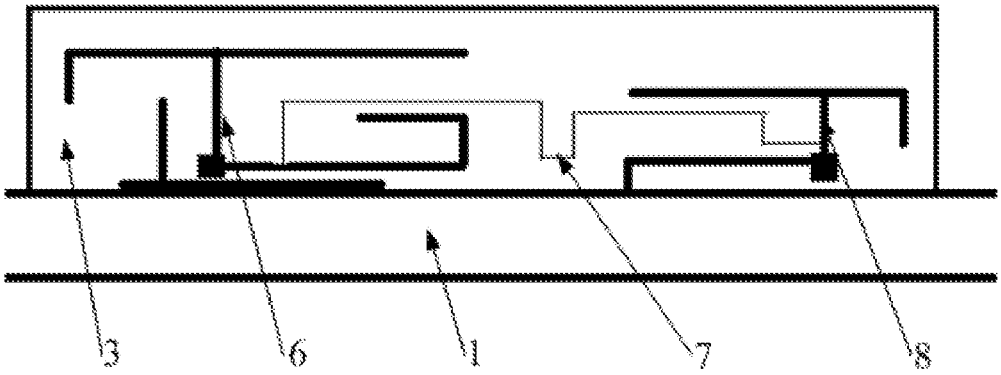
FIG. 2 illustrates a schematic structural diagram of antennas in an antenna assembly consistent with the disclosed embodiments.
Figure 3:
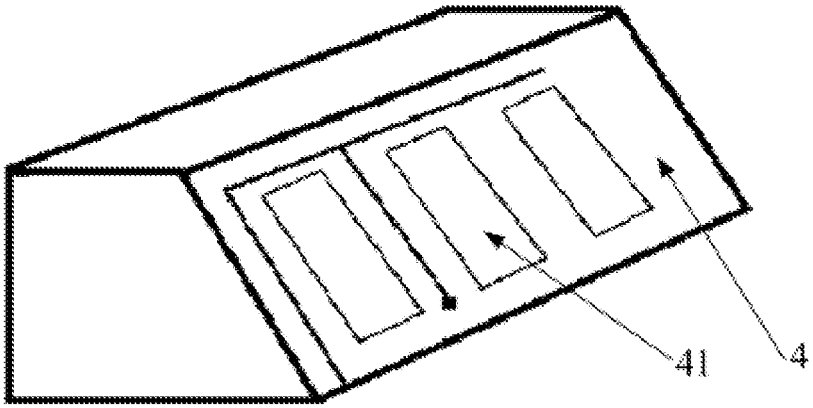
FIG. 3 illustrates a schematic structural diagram of a connection between a signal-transmitting conductive structure and an antenna consistent with the disclosed embodiments.

Referring to FIG. 1B, FIG. 2, and FIG. 3, the antenna assembly is disposed in an electronic device. The housing of the electronic device has a first part and a second part. The first part may be conductive (i.e., made of an electrically conductive material), and the second part may be a non-conductive. The antenna assembly may be disposed in an antenna cavity or chamber within the housing, and may include at least two antennas located in the same antenna cavity, and the antennas are used for excitation to radiate wireless signals. The antenna assembly may also include at least one isolation member disposed between the at least two antennas, and the isolation member is connected to the two antennas. The isolation member may be used to isolate the induced current of the two antennas, so as to reduce the interference between the two antennas on the same frequency and/or adjacent channels.

According to the present disclosure, the antenna assembly includes at least two antennas that are located in the same cavity, and an isolation member is used to isolate the induced currents of the two antennas, so as to reduce the interference between the two antennas on the same frequency and/or adjacent channels, thereby satisfying the requirement of the isolation between the antennas. Accordingly, the number of antenna windows is reduced, the window opening cost is reduced, at the same time the space required by the antenna is reduced, and the size of the electronic device is reduced.

Further, a part of the energy radiated by the antennas may be radiated out of the housing of the electronic device from the second part of the housing, and a part of the energy radiated by the antennas may form an oscillation in the cavity and is radiated out of the housing through the first part of the housing. That is, the disclosed antenna assembly may use the non-conductive part of the housing to radiate energy, and may also use the conductive part of the housing to radiate energy, thereby improving the signal radiation intensity of the antennas. Of course, the energy of the antennas may be radiated only from the second part of the housing or the first part of the housing.

The antenna assembly further includes a signal-transmitting conductive structure for coupling the antenna signal to the first part of the housing, and the signal-transmitting conductive structure is electrically connected to the first part of the housing. According to the present disclosure, the surface of the signal-transmitting conductive structure is metal or covered with a conductive material, and is electrically connected to the conductive first part of the housing. The signal-transmitting conductive structure may cause a part of the energy of the antenna to oscillate in the cavity and to be radiated out through the first part of the housing. The signal-transmitting conductive structure forms a cavity reflection, and strengthens interference with external noise, further ensuring the signal radiation intensity of the antennas. Of course, the present disclosure may also not include the signal-transmitting conductive structure, and directly couple the antenna signal to the first part of the housing.

In certain embodiments, one side of the signal-transmitting conductive structure near the antenna is a non-conductive part, and the other side is a conductive part. As shown in FIG. 1B, the housing includes a metal casing 1 and a plastic cover or other non-conductive cover 2. The housing also includes a signal-transmitting conductive structure, and the signal-transmitting conductive structure includes a plastic block 4 and a U-shaped metal frame 5. The U-shaped metal frame 5 wraps the plastic block 4 from three sides away from the antennas. That is, the U-shaped metal frame 5 wraps the plastic block 4 except the side near the antennas. Accordingly, by using the U-shaped metal frame 5 to form a cavity reflection, interference with external noise is strengthened (e.g., preventing the interference from the external noise). The plastic block 4 can better support the U-shaped metal frame 5 without affecting energy radiation, which improves the structural stability. In certain embodiments, the signal-transmitting conductive structure may only include the U-shaped metal frame 5 without the plastic block 4, or the U-shaped metal frame 5 may be replaced with a conductive layer plated on the surface of the plastic block 4.

It can be understood that the above-mentioned signal-transmitting conductive structure may only include a conductive part such as a metal flat plate, and the conductive part and the antenna have a certain distance from each other to form an energy cavity for energy collection and transmission.

That is, in certain embodiments, an antenna window may be opened on the metal casing 1 of the electronic device to place the antenna assembly, and the antenna window may be covered by a non-conductive material 2. The metal frame 5 may form an antenna cavity, together with the plastic block 4, and antennas may be disposed at certain positions of the antenna cavity to realize the radiation of the energy of the antennas. Various configurations may be used to implement the antenna assembly.

In order to facilitate the arrangement of the antennas, the antenna assembly further includes a support structure located in the cavity. For example, as shown in FIG. 1B, a printed circuit board (PCB) 3 may be provided in the cavity as the support structure. The at least two antennas may be both disposed on the support structure. According to the present disclosure, the antennas to be integrated on the support structure, simplifying the structure of the antenna assembly, facilitating installation, and saving space. It can be understood that the antennas described above may also be wires or metal pieces disposed separately, without limitation to the present disclosure. In one embodiment, the supporting structure is one side of the plastic block 4 near the antennas.

As shown in FIG. 2, when the supporting structure is PCB (printed circuit board) 3, the antennas may be integrated with the PCB 3, and PCB 3 integrated antennas may be vertically placed between the upper cover and the lower cover of the metal case 1 of the electronic device. The antennas may be on the side surface of PCB 3, near the edge. For example, the antennas may be a trace pattern on PCB 3, which is convenient for manufacturing.

As shown in FIG. 3, when the support structure is the side of the plastic block 4 near the antennas, the antennas may be electroplated on the plastic surface through LDS (laser direct structuring) plating, without the need to separately provide a support structure for the antennas, further simplifying the structure of the antenna assembly.

Further, the electronic device may need ventilation and heat dissipation, and the plastic block 4 may be provided with a plurality of heat dissipation holes 41 to speed up heat dissipation.

It can be understood that the above-mentioned support structure may also be other structures, such as a support frame, etc., which are not described in detail here.

In order to simplify the arrangement of the antennas, as shown in FIG. 2, there may be two antennas located in the same cavity, the first antenna 6 and the second antenna 8, respectively. The first antenna 6 and the second antenna 8 may be different. For example, the first antenna 6 may be one of the middle-high frequency antennas (multiple-input multiple-output or MIMO antennas) for the LTE (or 5G); and the second antenna 8 may be a WIFI antenna. Because both antennas use the same antenna cavity, no additional RF window needs to be opened and the size of the antenna assembly can be reduced, saving cost and reducing space requirements.

Of course, the antennas in the same cavity may also include three antennas, four antennas, etc., and the present disclosure does not intend to limit this. The first antenna 6 and the second antenna 8 may also be the same type, such as both being the LTE (or 5G) antennas, or other types of antennas.

The isolation member may be an isolation wire 7. One end of the isolation wire 7 is electrically connected to the first antenna 6, and the other end of the isolation wire 7 is electrically connected to the second antenna 8. In one embodiment, a ¼ wavelength isolation wire 7 may be provided between the first antenna 6 and the second antenna 8. That is, according to the present disclosure, between the MIMO antenna and the WIFI antenna, an isolation wire 7 of a ¼ wavelength may be added to enhance the isolation between the antennas. Such isolation wire 7 has a relatively simple structure and is convenient for installation. Of course, the isolation structure may also be an isolator or other structures capable of isolating the induced currents of two antennas.

The present disclosure further provides an electronic device including a housing and an antenna assembly. The housing has a first part and a second part, the first part is electrically conductive, and the second part is not electrically conductive. The second part is provided with an antenna window, and the antenna assembly is disposed in an antenna cavity in the antenna window. The antenna assembly can be the antenna assembly provided by any of the above disclosed embodiments. According, such approach reduces the window opening cost, reduces the space required by the antennas, and reduces the size of the electronic device. These advantages are brought by the antenna assembly, as explained in the above embodiments.

The electronic device in this embodiment may be a notebook computer, a mobile phone, a tablet computer, or other devices that need to be installed with an antenna.

In certain embodiments, the first part is a metal case 1 with one side open, and the opening is separated by a blocking part into at least two antenna windows. The blocking part is electrically connected to the metal case 1; the second part is a plastic case 2 that covers the antenna window. In this way, the energy of the antennas is radiated out through the plastic case 2.

In certain embodiments, the electronic device has a metal case 1 with one side open, which can ensure the strength of the metal case while reducing the number of windows to be opened, facilitating the manufacturing process and reduces the manufacturing cost of the antenna to a large extent. Further, the additional two MIMO antennas add extra space; in addition, the present disclosure also reduces the effect of opening a window on the metal housing 1 on the ID effect.

In certain embodiments, the blocking part may be a metal block or another material structure with a conductive surface, and is specifically welded to the upper cover and the lower cover of the metal casing 1 to realize isolation between two or more antenna cavities.

Of course, the housing of the present disclosure may also have other structures, such as a metal housing with a machine-made antenna window, or only the upper and lower covers are made of metal, and the other parts are plastic casings, details of which are not described herein.

Further, the various disclosed embodiments are described in a progressive manner, each embodiment focuses on certain aspects, the embodiments may be referred to with each other, and features from different embodiments may be combined or exchanged.

Further, it should be noted that, with respect to each of the foregoing embodiments, relational terms such as first, second, and the like are only adopted to distinguish one operation, unit or module from another operation, unit or module. The relational terms do not necessarily require or imply any such actual relationship or order between the operations, units and modules. Furthermore, the terms "including", "comprising", or any other variation thereof are intended to cover a non-exclusive inclusion, such that a process, method or system that comprises a list of elements includes not only those elements, but also other elements not explicitly listed or inherent to such process, method or system. An element defined by the phrase "comprising a . . . " without further limitation does not exclude the presence of additional identical elements in the process, method or system that includes the element.

The above description of the disclosed embodiments enables those skilled in the art to make or use the disclosure. Various modifications to these embodiments are obvious to those skilled in the art. The general principles defined herein may be implemented in other embodiments without departing from the spirit or scope of the disclosure. The present disclosure is not intended to be limited to the embodiments shown herein, but is to be accorded the broadest scope consistent with the principles and novel features disclosed herein.

What is claimed is:

1. An antenna assembly for an electronic device having a housing, wherein the housing includes a first portion and a second portion, the first portion is electrically conductive, and the second portion is non-conductive, the antenna assembly comprising:

an antenna cavity;

at least two antennas located in the antenna cavity, where the antennas are used for radiating energy; and at least one isolation structure, wherein the isolation structure is disposed between the two antennas and connected to the two antennas, and the isolation structure isolates induced currents of the two antennas to reduce interference at a same frequency or from adjacent frequency channels between the two antennas.

2. The antenna assembly according to claim 1, wherein a part of the energy is radiated from the second portion of the housing, and another part of the energy forms an oscillation in the antenna cavity and is radiated out through the first portion of the housing.

3. The antenna assembly according to claim 2, wherein:
the antenna cavity includes a signal-transmitting conductive structure for coupling an antenna signal to the first portion of the housing, and
the signal-transmitting conductive structure is electrically connected to the first portion of the housing.

4. The antenna assembly according to claim 3, wherein:
one side of the signal-transmitting conductive structure near the antennas is a non-conductive portion, and the other side of the signal-transmitting conductive structure is a conductive portion, and
the signal-transmitting conductive structure includes a plastic block and a U-shaped metal frame wrapping on three sides of the plastic block away from the antennas.

5. The antenna assembly according to claim 4, further comprising:
a support structure located in the antenna cavity, wherein the two antennas are both disposed on the support structure.

6. The antenna assembly according to claim 5, wherein:
the support structure is a printed circuit board (PCB) or a side of the plastic block close to the antennas, and
the plastic block is provided with a plurality of heat dissipation holes.

7. The antenna assembly according to claim 6, wherein the at least two antennas include a first antenna and a second antenna, different from the first antenna.

8. The antenna assembly according to claim 7, wherein:
the isolation structure is an isolation wire, and
one end of the isolation wire is electrically connected to the first antenna, and the other end of the isolation wire is electrically connected to the second antenna.

9. A method for providing an antenna assembly for an electronic device having a housing, wherein the housing includes a first portion and a second portion, the first portion is electrically conductive, and the second portion is non-conductive, the method comprising:
providing an antenna cavity in the electronic device;
disposing at least two antennas in the antenna cavity, where the antennas are used for radiating energy; and
providing at least one isolation structure between the two antennas,
wherein the isolation structure is connected to the two antennas, so as to isolate induced currents of the two antennas to reduce interference at a same frequency or from adjacent frequency channels between the two antennas.

10. The method according to claim 9, wherein:
a part of the energy is radiated from the second portion of the housing, and another part of the energy forms an oscillation in the antenna cavity and is radiated out through the first portion of the housing,
the antenna cavity includes a signal-transmitting conductive structure for coupling an antenna signal to the first portion of the housing, and
the method further includes:
electrically connecting the signal-transmitting conductive structure to the first portion of the housing.

11. The method according to claim 10, wherein:
one side of the signal-transmitting conductive structure near the antennas is a non-conductive portion, and the other side of the signal-transmitting conductive structure is a conductive portion, and
the signal-transmitting conductive structure includes a plastic block and a U-shaped metal frame wrapping on three sides of the plastic block away from the antennas.

12. The method according to claim 11, further comprising:
providing a support structure in the antenna cavity, and disposing both of the two antennas on the support structure,
wherein the support structure is a printed circuit board (PCB) or a side of the plastic block close to the antennas, and the plastic block is provided with a plurality of heat dissipation holes.

13. The method according to claim 12, wherein:
the at least two antennas include a first antenna and a second antenna, different from the first antenna,
the isolation structure is an isolation wire, and
the method further includes:
electrically connecting one end of the isolation wire to the first antenna, and the other end of the isolation wire to the second antenna.

14. An electronic device, comprising:
a housing, wherein the housing includes a first portion and a second portion, the first portion is electrically conductive, and the second portion is non-conductive; and
an antenna assembly including:
an antenna cavity disposed in the housing;
at least two antennas located in the antenna cavity, where the antennas are used for radiating energy; and
at least one isolation structure,
wherein the isolation structure is disposed between the two antennas and connected to the two antennas, and the isolation structure isolates induced currents of the two antennas to reduce interference at a same frequency or from adjacent frequency channels between the two antennas.

15. The electronic device according to claim 14, wherein:
the first portion is a metal case with one side opened to form an opening,
the opening is separated by a blocking portion into at least two antenna windows
the blocking portion is electrically connected to the metal case, and
the second portion is a plastic case that covers the antenna windows.

16. The electronic device according to claim 15, wherein a part of the energy is radiated from the second portion of the housing, and another part of the energy forms an oscillation in the antenna cavity and is radiated out through the first portion of the housing.

17. The electronic device according to claim 16, wherein:
the antenna cavity includes a signal-transmitting conductive structure for coupling an antenna signal to the first portion of the housing, and
the signal-transmitting conductive structure is electrically connected to the first portion of the housing.

18. The electronic device according to claim 17, wherein:
one side of the signal-transmitting conductive structure near the antennas is a non-conductive portion, and the other side of the signal-transmitting conductive structure is a conductive portion, and
the signal-transmitting conductive structure includes a plastic block and a U-shaped metal frame wrapping on three sides of the plastic block away from the antennas.

19. The electronic device according to claim 18, wherein the antenna assembly further includes:
a support structure located in the antenna cavity, wherein the two antennas are both disposed on the support structure.

20. The electronic device according to claim 19, wherein:

the support structure is a printed circuit board (PCB) or a side of the plastic block close to the antennas, and the plastic block is provided with a plurality of heat dissipation holes.

* * * * *